United States Patent [19]

Araki et al.

[11] Patent Number: 4,713,871

[45] Date of Patent: Dec. 22, 1987

[54] METHOD FOR PRODUCING AMORPHOUS ALLOY SHAPED ARTICLES

[75] Inventors: Masatada Araki, Handa; Yutaka Kuroyama; Yukihisa Takeuchi, both of Chita; Makoto Takagi, Okazaki; Toru Imura, Nagoya, all of Japan

[73] Assignees: Nippon Oil & Fats Co., Ltd.; Nippon Denso Co., Ltd., both of Japan

[21] Appl. No.: 803,238

[22] Filed: Dec. 2, 1985

[30] Foreign Application Priority Data

Dec. 12, 1984 [JP] Japan ..... 59-260844
Jul. 25, 1985 [JP] Japan ..... 60-162899

[51] Int. Cl.[4] ..... B22F 1/00
[52] U.S. Cl. ..... 29/421 E; 419/51
[58] Field of Search ..... 29/421 E; 319/48, 51; 148/403

[56] References Cited

U.S. PATENT DOCUMENTS 3,084,398 4/1963 Swed .
3,112,166 11/1963 Thornhill .
3,568,248 3/1971 Cowan .
4,490,329 12/1984 Hare et al. ..... 419/51

FOREIGN PATENT DOCUMENTS 0052587 5/1982 European Pat. Off. .
0124699 11/1984 European Pat. Off. .

*Primary Examiner*—Timothy V. Eley
*Attorney, Agent, or Firm*—Parkhurst & Oliff

[57] ABSTRACT

Amorphous alloy shaped articles having excellent magnetic properties, high hardness and strength, or high corrosion resistance can be obtained by a method, wherein amorphous alloy or atomized alloy raw material powder layer is laminately arranged adjacently to a metal powder layer having a shock impedance a little different from that of the raw material powder layer, and a shock pressure is applied to the raw material powder layer.

13 Claims, 9 Drawing Figures

METHOD FOR PRODUCING AMORPHOUS ALLOY SHAPED ARTICLES

BACKGROUND OF THE INVENTION

1. Field of the Invention

The present invention relates to a method for producing amorphous alloy shaped articles, and more particularly relates to a method for producing amorphous alloy shaped articles, wherein a high-energy shock pressure is applied to so-called amorphous alloy or substantially amorphous alloy raw material powders to press the raw material powders into a compact body.

The term "amorphous alloy raw material powders" used in the present invention means as follows.

In general, the term "amorphous alloy powders" means powders consisting only of amorphous alloy powders, which are obtained by cooling forcedly a melted alloy at a very high cooling rate of $10^{4°}$–$10^{6°}$ C./sec, and powders obtained by pulverizing a thin strip, fine wire or thin film, which consists of amorphous alloy and has been produced by the rapid cooling method or other commonly known methods. However, in the present invention, in addition to the above described amorphous alloy powders, atomized alloy powders, which have been obtained by cooling a melted alloy at a very high cooling rate and have a hardness and a strength higher than those of ordinary crystalline alloy powders, are included in the amorphous alloy powders. That is, the term "amorphous alloy powders" to be used as a raw material for the production of the amorphous alloy shaped article in the present invention includes amorphous alloy powders and atomized alloy powders.

2. Related Art Statement

Amorphous alloy is generally produced by the above described super rapid cooling method and further by other various methods, such as spatter method, gaseous phase chemical reaction method, metal plating method and the like. However, all the resulting amorphous alloys are thin strip, fine wire and powdery product, and even amorphous ribbons produced by a centrifugal method, a single roll method or the like, have only a thickness of from about several tens μm to about several hundreds μm, in which method a melted amorphous alloy is continuously jetted on a rotating body while cooling the body in order to cool the jetted alloy. Similarly, the thin strip, fine wire and fine powders produced in the same methods as described above have substantially the same thickness as that of the ribbon. Therefore, conventional amorphous alloys have hitherto been used in a very limited use field.

In order to apply amorphous alloy in a wide used field, amorphous alloy shaped articles having a larger size are required, and methods for producing large size amorphous alloy shaped articles have been investigated. However, amorphous alloy has a high hardness, and particularly amorphous alloy is converted into crystalline alloy by heating, and therefore it is very difficult to produce amorphous alloy shaped articles.

There has been disclosed in Japanese Patent Laid-open Application No. 7,433/84 a method, wherein amorphous alloy powders are packed in a metal vessel, and the packed powders are pressed into a compact body by applying to the powders from the surroundings of the vessel a shock pressure generated by the explosion of an explosive. Further, there has been known a method, wherein a high-speed flying body projected by a gun is enabled to collide with amorphous alloy powders to cause a shock pressure in the powders and to produce an amorphous alloy shaped article.

Amorphous alloy powders have a hardness remarkably higher than that of crystalline alloy powders, and unless a shock pressure having an energy high enough to form the powders into a shaped article is uniformly acted upon the amorphous alloy powders, a uniform shaped article can not be obtained. While, when the shock pressure is too high, the resulting amorphous alloy shaped article often contains crystallized portion, cracks, crevices, cavities and the like.

In the above described conventional methods, it is necessary to change or control properly the production condition for an amorphous alloy shaped article depending upon the amount of raw material powders to be charged, the layer thickness of the charged raw material powders, and the like. As the charged amount is the larger, the resulting shaped article is apt to be crystallized the more easily, and further cracks, crevices, cavities and the like are the more easily formed in the resulting shaped article.

The reason lies in that, when amorphous alloy powders are applied with a shock pressure high enough to bond fellow particles of the powders, the resulting shaped article is wholly exposed to an extraordinarily high stress, and cracks and the like are formed in the shaped article.

When amorphous alloy powders are packed in a vessel, voids are always formed between fellow particles. When it is intended to produce a high-density shaped article, the amorphous alloy powders must be plastically deformed by a shock pressure until the voids are extinguished, and further adjacent particles must be closely approached to each other, whereby the alloy powders are monolithically bonded to each other such that the boundary of fellow particles can not be substantially observed even by a microscopic observation. In this treatment, the very high hardness of amorphous alloy hinders the close approaching of adjacent powder particles through the extinction of voids and the bonding of the approached particles. That is, the hardness of a material can be regarded as an indication of the deformability of the material. Because, a material having a higher hardness is more difficult to be deformed, and a material having a lower hardness is more easily deformed.

Amorphous alloy powders are more difficult to be deformed than conventional crystalline metal powders, and a large shock pressure must be applied to amorphous alloy powders in order to deform them, and it is very difficult to deform particles of amorphous alloy powders and further to approach fellow deformed particles to each other and to bond the approached particles. That is, when amorphous alloy powders are pressed under a very high shock pressure, the alloy powders are easily deformed to extinguish voids between the fellow particles of the powders and to achieve satisfactorily the bonding of the fellow particles. However, an excessively high shock pressure applied to amorphous alloy powders not only acts to extinguish voids between the fellow particles of the amorphous alloy powders and to bond the particles, but also gives a destructive stress to the whole body of the resulting shaped article, and hence a large amount of cracks are formed in the resulting shaped article.

When it is intended to produce an amorphous alloy shaped article by pressing amorphous alloy powders, the amorphous powders must be applied with a shock pressure having a strength, which is necessary for bonding fellow particles of the powders but does not form cracks and the like in the resulting shaped article.

When amorphous alloy raw material powders are charged, for example, in a hollow cylindrical pressing vessel, and a shock pressure is applied to the powders from the outer periphery of the vessel to produce a shaped article, the pressure goes centripetally from the outer periphery of the vessel towards the interior of the raw material powder layer, and concentrates to the center portion of the powder layer, and the pressure rises extraordinarily at the center portion. As the result, as a secondary phenomenon, a pressure higher than the original shock pressure reflects radially from the center portion of the powder layer.

This reflected pressure acts on the raw material powder layer from its center portion towards its outside, and tubular voids are formed at the center portion of the raw material powder layer, and a large number of crevices and fine voids are formed from the center portion of the raw material powder layer towards its outside.

The object of the present invention is to obviate the formation of the above described cracks, crevices and voids during the production of the shaped article.

SUMMARY OF THE INVENTION

The inventors have made various theoretical and experimental investigations with respect to the above described bonding mechanism of amorphous alloy powders and to the fundamental properties of a shaped article to be produced, and as the result the inventors have succeeded in the production of an amorphous alloy shaped article having a high density and a high bonding strength between fellow particles, and being substantially free from flaws, such as cracks, crevices, voids and the like, by utilizing a high-energy shock pressure generated by the explosion of an explosive.

The feature of the present invention lies in a method for producing amorphous alloy shaped articles, wherein a shock pressure is applied to an amorphous alloy or atomized alloy raw material powder layer to press the powder layer into a compact body, an improvement comprising arranging laminately the raw material layer adjacently to a metal powder layer having a shock impedance nearly equal to or a little different from that of the raw material powder layer, and applying a shock pressure to the raw material powder layer.

BRIEF DESCRIPTION OF THE DRAWINGS

For a better understanding of the invention, reference is taken to the accompanying drawings, wherein.

DESCRIPTION OF THE PREFERRED EMBODIMENTS

Figure 1:
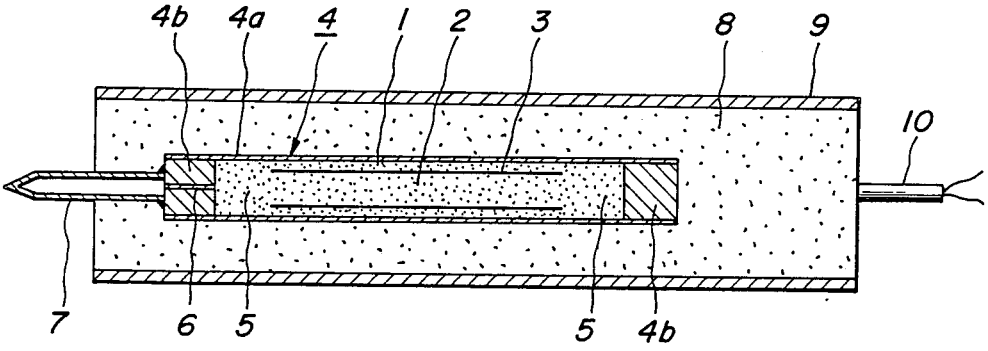
FIG. 1 is an explanative sectional view of an apparatus used for carrying out one embodiment of the method of the present invention.
Figure 2:
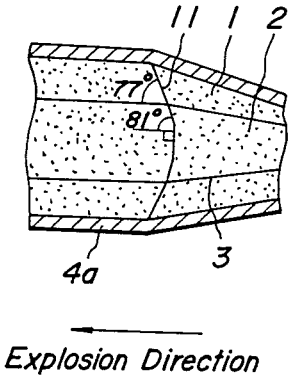
FIG. 2 is an explanative sectional view, in an enlarged scale, of a part of a pressing metal vessel arranged in the apparatus shown in FIG. 1, illustrating the front of the shock wave generated in the method shown in FIG. 1.
Figure 3:
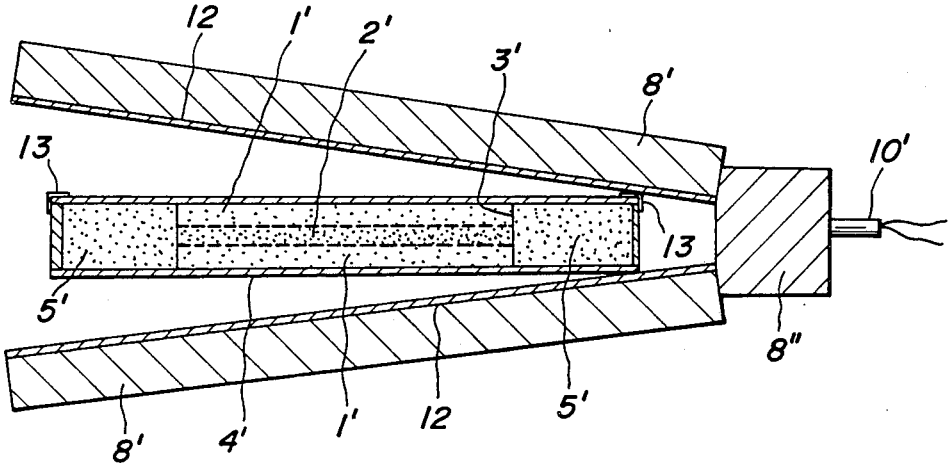
FIG. 3 is an explanative sectional view of an apparatus used for carrying out another embodiment of the method of the present invention.
Figure 4:
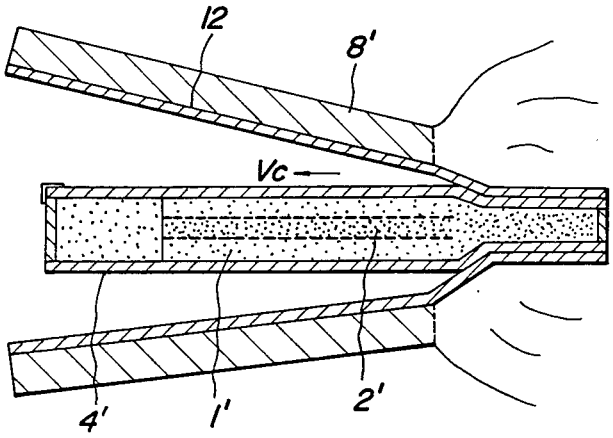
FIG. 4 is an explanative sectional view, in an enlarged scale, of a part of the apparatus shown in FIG. 3, illustrating the proceeding of the explosion of an explosive in the method shown in FIG. 3.

FIG. 1 is an explanative sectional view of an apparatus used for producing an amorphous alloy shaped article in one embodiment of the method of the present invention; and FIG. 2 is an explanative sectional view, in an enlarged scale, of a part of a pressing metal vessel arranged in the apparatus shown in FIG. 1, illustrating the pressing behavior of an explosive in the method shown in FIG. 1. FIG. 3 is an explanative sectional view of an apparatus used for producing an amorphous alloy shaped article in another embodiment of the method of the present invention; and FIG. 4 is an explanative sectional view, in an enlarged scale, of a part of the apparatus shown in FIG. 1, illustrating the proceeding of the explosion of an explosive in the method shown in FIG. 3.

The method illustrated in FIGS. 1 and 2 is particularly advantageous for the production of a cylindrical or hollow cylindrical amorphous alloy shaped article.

Referring to FIGS. 1 and 2, the numeral 1 represents an amorphous alloy or atomized alloy raw material powder layer, the numeral 2 represents a metal powder layer arranged laminately and adjacently to the raw material powder layer 1, the numeral 3 represents an amorphous alloy foil and the numeral 4 represents a pressing vessel made of metal. The pressing metal vessel 4 consists of, for example, a copper tube 4*a* and steel plugs 4*b*. An amorphous alloy foil 3 is rolled into a hollow cylinder having a diameter smaller than the inner diameter of the copper tube 4*a* and filled with metal powders to form a metal powder layer 2. The metal powder layer 2 wrapped with the amorphous alloy foil 3 is arranged in the center portion of the interior of the copper tube 4*a* in the form of a core, and amorphous alloy or atomized alloy raw material powders are filled in the gap between the amorphous alloy foil 3 and the copper tube 4*a* to form the above described amorphous alloy or atomized alloy raw material powder layer 1 around the metal powder layer 2. In FIG. 1, the numeral 5 represents a metal powder layer filled in spaces between the steel plugs 4*b* and both ends of the hollow cylindrical amorphous alloy foil 3. When the metal powder layer 2 can be partitioned from the raw material powder layer 1, the amorphous alloy foil 3 may be omitted, or the amorphous alloy foil 3 may be replaced by a metal foil.

The pressing metal vessel 4 is communicated to an evacuating copper pipe 7 through an exhaust hole formed in one of the steel plugs 4*b* of the vessel 4 such that, when the raw material powder layer is applied with a high-energy shock pressure, the influence of the environmental atmosphere is suppressed as low as possible. This exhaust hole is stopped up with a graphite round rod 6 such that the powders in the vessel 4 will not go out from the vessel 4, and then the vessel 4 is embedded in the center of the steel tube 9 previously charged with an explosive 8. An electric blasting cap 10 is connected to the explosive 8.

The explosive 8 is exploded by applying an electric current to the electric blasting cap 10, and the explosion pressure acts on the raw material powder layer 1 from the outer periphery of the metal vessel 4. In this case, the shock wave is propagated through the raw material powder layer 1. In FIG. 2, the numeral 11 represents the front of the shock wave.

The method illustrated in FIGS. 3 and 4 is adapted to produce an amorphous alloy shaped article board. In the center portion of a box-shaped metal vessel 4' are arranged an amorphous alloy or atomized alloy raw material powder layer 1', a metal powder layer 2' and again an amorphous alloy or atomized alloy raw material powder layer 1' from the bottom of the vessel in this order so as to form a laminated powder layer assembly. Further, the laminated powder layer assembly is surrounded with a partition formed of an amorphous alloy foil 3', and metal powders 5' are filled in a gap formed between the amorphous alloy foil 3' partition and the periphery of the vessel 4'.

Metal plates, for example, steel plates 12, are arranged at the outerside of the vessel 4' such that the steel plates are inclined at certain given angles with respect to the upper surface and the lower surface of the vessel 4' respectively, and an explosive 8' is stuck on the surface of the outerside of each metal plate, and another explosive 8'' which is the same kind as the explosive 8', is arranged so as to be contacted with the upper and lower explosives 8', and an electric blasting cap 10' is fitted to the center portion of the end surface of the explosive 8'', whereby the explosive 8' is connected to the electric blasting cap 10' through the explosive 8''. FIG. 3 illustrates diagrammatically a state wherein an evacuating copper tube shown in FIG. 1 has already been cut off. The numeral 13 in FIG. 3 represents a polyvinyl chloride tape for vacuum sealing.

In the method illustrated in FIGS. 3 and 4, when an electric current is applied to the electric blasting cap 10', the explosives 8'' and 8' are successively exploded, and the upper and lower steel plates 12 collide with the vessel 4' at the surfaces, which are faced to the upper and lower steel plates 12 respectively, at a high speed, whereby the steel plates collide successively and continuously with the upper and lower surfaces corresponding to the proceeding of the explosion.

FIG. 4 illustrates the process, wherein the steel plates 12 collide successively and continuously with the surfaces of the vessel 4' corresponding to the proceeding of explosion. In FIG. 4, the reference $V_c$ represents the velocity of the proceeding of collided portion.

The above described methods of the present invention are optimum methods for applying a high-energy shock pressure to raw material powders depending upon the shape of the shaped articles to be produced, for example, cylindrical shape, hollow cylindrical shape, or plate-like shape. However, the shape and material of the metal vessel can be freely selected depending upon the shape demanded in the resulting shaped articles.

The composition of raw material powders of amorphous alloy or atomized alloy to be used in the present invention is not particularly limited. Typical compositions of the amorphous alloy raw material powders are a composition consisting mainly of iron, boron and silicon or of nickel, boron and silicon, and the like; and typical compositions of atomized alloy powders are compositions of high speed steels, die steels, high tension steels and the like. In general, the amorphous alloy to be used in the present invention is a three-component or four-component alloy having a composition containing a magnetic transition metal, such as iron, cobalt, nickel or the like, as a main component, and further containing silicon, boron and phosphorus as an element for ensuring the formation of amorphous texture in the alloy. The amorphous alloy may further contain sulfur, selenium and the like. In the present invention, atomized alloy powders obtained by a rapid cooling method can be used as raw material powders, because the atomized alloy powders are hard and difficult to be formed into a shaped article.

The inventors have investigated theoretically and experimentally the shape and particle size of the amorphous alloy or atomized alloy raw material powders, and have found that, in order to obtain a good shaped article, it is preferable that the raw material powders consist of larger size particles (referred to as "first group particles") and smaller size particles (referred to as "second group particles") in a mixing ratio of the first group particles to the second group particles within the range of from 1:1 to 10:1 (in weight ratio), that the ratio of an average diameter of the first group particles to an average diameter of the second group particles lies within the range of from 2:1 to 5:1, that the ratio of maximum diameter to minimum diameter in each particle is not higher than 3:1, that the average value of the ratios of maximum diameter to minimum diameter in all the particles is not higher than 2:1.

The metal powders to be used in combination with the amorphous alloy or atomized alloy raw material powders in the present invention include powders of any metals, for example, powders of iron, nickel, titanium, copper, zirconium, hafnium, chromium, silicon and cobalt, powders of alloys of these metals, and stainless steel powders.

In the present invention, the above described 2 kinds of powders are properly selected depending upon the use of the resulting shaped article.

The 2 kinds of powders may be packed and arranged in a pressing vessel such that they are directly contacted with each other at their boundary; or they may be separated from each other by a foil or thin sheet made of an amorphous alloy or metal used as a partition, or they may be mixed with each other in a small amount at their boundary without using a partition so long as the reflection of shock wave can be substantially neglected. In the method for producing amorphous alloy shaped articles of the present invention, the difference in shock impedance between the amorphous alloy or atomized alloy raw material powder layer and the metal powder layer is preferably such that the shock impedance of the metal powder layer is not more than 70% higher or lower than the shock impedance of the amorphous alloy or atomized alloy raw metal powder layer in order to suppress the reflection of harmful shock wave, which forms cracks and voids in the interior of the resulting amorphous alloy shaped article, as small as possible.

The high-energy shock pressure to be applied to the laminated raw material powder layer assembly in the present invention is preferably at least 5 GPa and more preferably at least 8 PGa. When the shock pressure is lower than 5 GPa, the resulting shaped article contains sometimes unsatisfactorily bonded particle portions, and the use of a shock pressure lower than 5 GPa is not preferable.

As described above, when a high-energy shock pressure is applied to the laminated assembly of raw material powder layer and metal powder layer, the pressure is transmitted from the raw material powder layer to the metal powder layer, and the reflection of the shock pressure is absorbed and relaxed by the metal powders during the course of pressing a laminated assembly of the raw material powder layer and metal powder layer into a compact body, and hence the resulting shaped article is substantially free from the formation of flaws, such as cracks, crevices and the like.

The term "substantially free from flaws" means as follows. When row material powders are pressed by means of an explosive, the working condition may be shifted from the preset condition in some portions, and the resulting shaped article may have unsatisfactory density and magnetic properties in these portions. Moreover, the resulting shaped article may have portions, wherein very small flaws have been formed due to the same reason.

For example, when amorphous alloy powders are filled in a hollow metal cylinder and both ends of the cylinder are sealed with metal plugs, the above described flaws are sometimes formed due to the difference in shock impedance between the amorphous alloy powders and the metal plugs. However, portions, wherein such flaws may be formed, can be forecast. Therefore, when amorphous alloy powders to be filled in such portions are replaced by a dummy of metal powders, the flaws, which will be caused in the amorphous alloy portion, can be suppressed as small as possible.

The outline of the reason why excellent amorphous alloy shaped articles having substantially no cracks nor voids in their interior can be obtained in the present invention, has been explained hereinbefore. Further, the reason will be explained in more detail hereinafter together with the condition for producing the above described excellent amorphous alloy shaped articles.

It is known that there are the following relations between the pressure P in a substance, the shock wave velocity $U_s$, the moving velocity $U_p$ of the substance and the initial density $\rho_o$ of the substance in the case where a shock pressure is applied to the substance:

$$P=\rho_o \cdot U_s \cdot U_p \quad (1)$$

$$\rho_o/\rho=(U_s-U_p)/U_s \quad (2)$$

In the above formulae, $\rho$ represents an arrived density of a substance compressed by applying the shock pressure to the substance.

In the above described formulae (1) and (2), either of a combinations of the initial density $\rho_o$ of the substance, the shock wave velocity $U_s$ and the moving velocity $U_p$ of the substance, or a combination of the initial velocity $\rho_o$ of the substance, the arrived pressure P in the substance and the arrived density $\rho$ of the compressed substance is found out, the value of the remaining elements in the formula can be calculated.

When a first body, which is flying at a high speed, collides with a second body to generate a shock pressure in the second body, the pressure is determined from a condition which satisfies the following formula (3):

$$P=\rho_o \cdot U_s \cdot U_p=\rho_o' \cdot U_s' \cdot U_p' \quad (3)$$

In the formula (3), the values of the elements of $\rho_o'$, $U_s'$ and $U_p'$ are values of the second body and correspond to the values of $\rho_o$, $U_s$ and $U_p$ of the first body, respectively. Strictly speaking, when an explosion pressure of an explosive is transmitted to a substance to be shocked, it is necessary that the pressure generated in the substance is determined by carrying out the above described calculation, or determined by a measurement. The detailed method for the determination of the pressure is described, for example, in Solid State Physics, Vol. 6, edited by Seitz, F. & Turbull, D., and published by Academic Press, New York, 1985.

Further, it is known that there is a linear relation represented by the formula (4)

$$U_s=C+S \cdot U_p \quad (4)$$

between the shock wave velocity $U_s$ and the moving velocity $U_p$ of a substance with respect to various substances. The relation is useful for solving the formula (3). In the formula (4), C represents a constant and S represents a coefficient. The values of C and S are described, for example, in the Journal of Applied Physics, 32, 1253 (1960) and in the Stanley P. Marsh, "LASL (Los Alamos Scientific Laboratory), Shock Hugonuot Data", University of California Press (1980).

Substantially all of the data described in these publications relate to solids substantially having a theoretical density. These publications describe few data for a case wherein a shock is applied to a substance having voids in its interior, for example, a spongy mass of metal powders. Accordingly, when it is intended to determine the pressure generated in a mass of powders by applying a shock to the mass, there are substantially no data which can be used as basic data for the calculation. However, the above described elements in a substance having voids homogeneously dispersed therein, for example, in a mass of powders, that is, in a substance having an initial density, before a shock is applied to the substance, lower than its theoretical density can be calculated by the following formula (5) from the shock data of the substance having substantially the theoretical density in the solid state.

$$P_p=P[1-\rho_o \cdot \gamma_o(V_o-V)/2]/[1-\rho_o \gamma_o(V_{op}-V)/2] \quad (5)$$

In the above formula (5), $P_p$ represents a pressure generated in a solid having a density lower than its theoretical density, P represents a pressure generated in a solid having a theoretical density, $\gamma_o$ represents a Grüneisen coefficient, $V_o$ and $V_{op}$ represent specific volumes under normal temperatures and normal pressures of a solid having a theoretical density and of a solid having a density lower than its theoretical density due to the presence of voids contained therein respectively, and V represents a specific volume of both the solids when they are pressed up to the pressures of P and $P_p$.

It is known that there is a relation represented by the following formula (6) in the Grüneisen coefficient $\gamma_o$:

$$\rho_o \cdot \gamma_o=\rho \cdot \gamma \quad (6)$$

The formula (6) means that the product of density and Grüneisen coefficient in a solid is always constant regardless of pressure. For example, it is reported tha $\gamma_o$ of iron is 1.69.

It is possible to calculate the pressure applied to a substance by using the above explained formulae (1)–(6). However, the behavior under shock pressure of amorphous alloys having various compositions has not yet been substantially known.

The inventors have used, in the calculation of the shock pressure to be applied to an amorphous alloy, shock elements of the main component of the amorphous alloy in place of the shock elements of the amorphous alloy. That is, for example, iron has a density of 7.85 g/cm$^3$ and under normal temperatures and normal pressures, while an amorphous alloy consisting mainly of iron (iron: 75 wt%, boron: 15 wt%, and silicon: 10 wt%) has a density of 7.38 g/cm$^2$ under normal temperatures and normal pressures. Therefore, when a calibration between the density of the alloy and that or iron has been previously effected, the behavior of an amorphous alloy consisting mainly of iron can be determined without troubles.

Further, when the initial density of an iron-base amorphous alloy to be actually applied with a shock is used in $V_{op}$ in formula (5), and the relation of $P-V_o-V$ of iron under shock is used in place of the relation of $P-V_o-V$ of the iron-base amorphous alloy, it is not substantially necessary to effect a particular calibration. In addition to these, when calculating various values on iron-base amorphous alloys, an $U_s-P_p$ relation of higher than 13 GPa plastic wave of iron was employed from two plastic waves.

Figure 5:
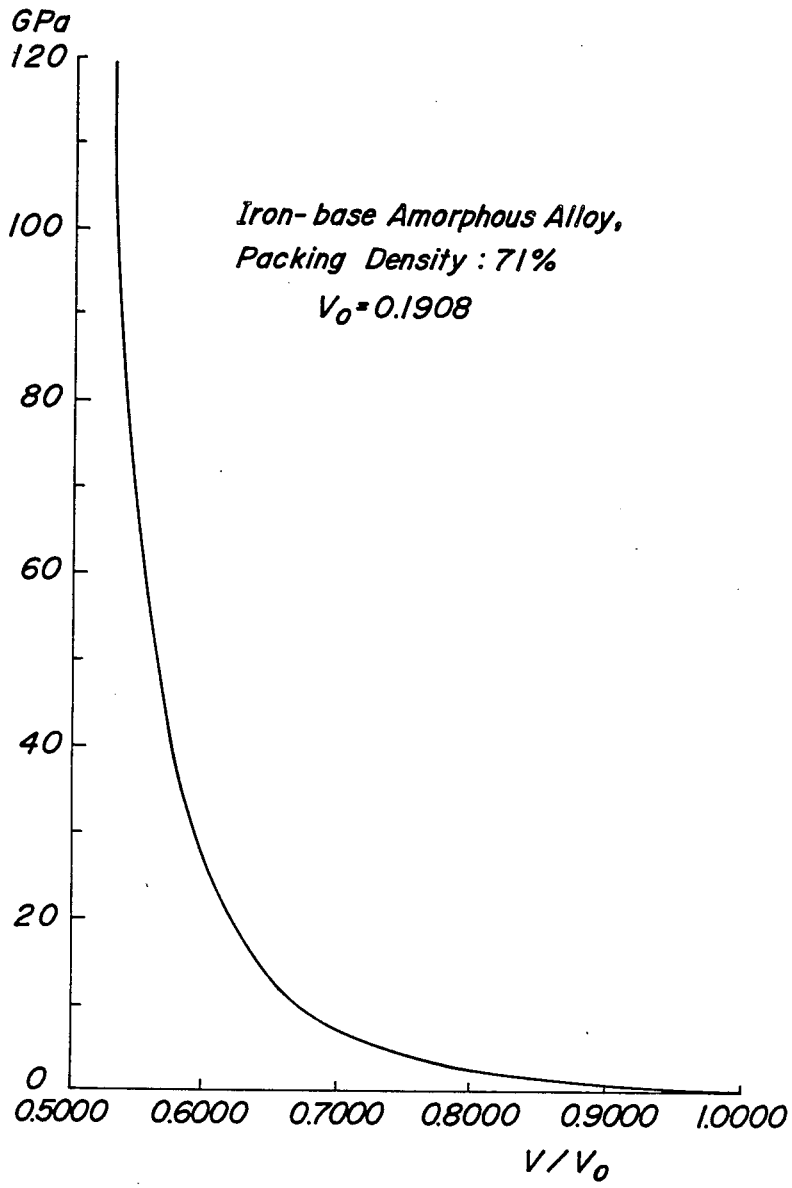
FIG. 5 is a specific volume-pressure curve of iron-base amorphous alloy powders having a packing density percentage of 71%.

FIG. 5 is a specific volume-pressure curve of an iron-base amorphous alloy having a packing density of 71% based on the density of 7.38 g/cm$^3$ measured by the Archimedes' method. In the specification of the present application, the pressure is calculated by the relation shown in FIG. 5 or by a specific volume-pressure relation determined in the same manner as used in the determination of the relation of FIG. 5.

Figure 6:
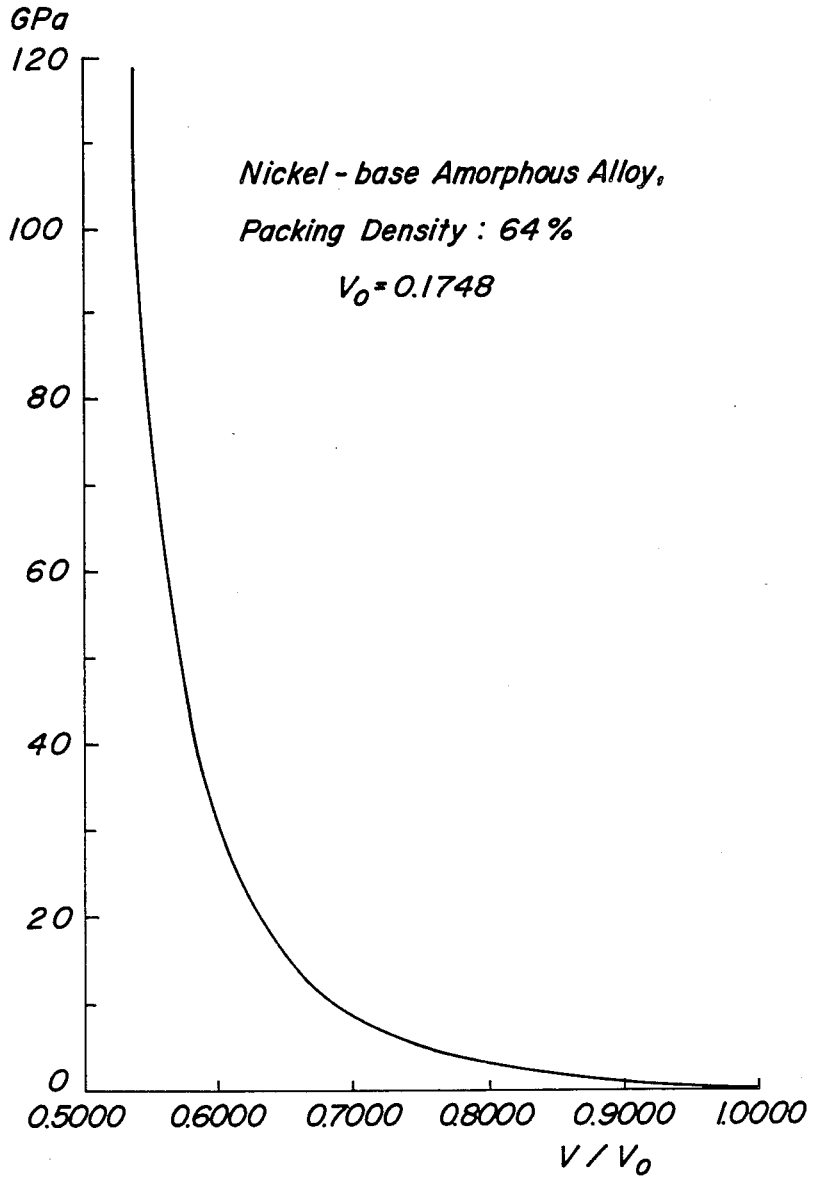
FIG. 6 is a specific volume-pressure curve of nickel-base amorphous alloy powders having a packing density percentage of 64%.

FIG. 6 is a specific volume-pressure curve of a nickel-base amorphous alloy, which is obtained by using the shock characteristics of nickel in place of the shock characteristics of the nickel-base amorphous alloy. The pressure relating to the nickel-base amorphous alloy was calculated based on the relation. The nickel-base amorphous alloy used in this calculation had a packing density of 5.72 g/cm$^3$, which was 64% based on the density of 8.907 g/cm$^3$ of nickel.

Figure 7:
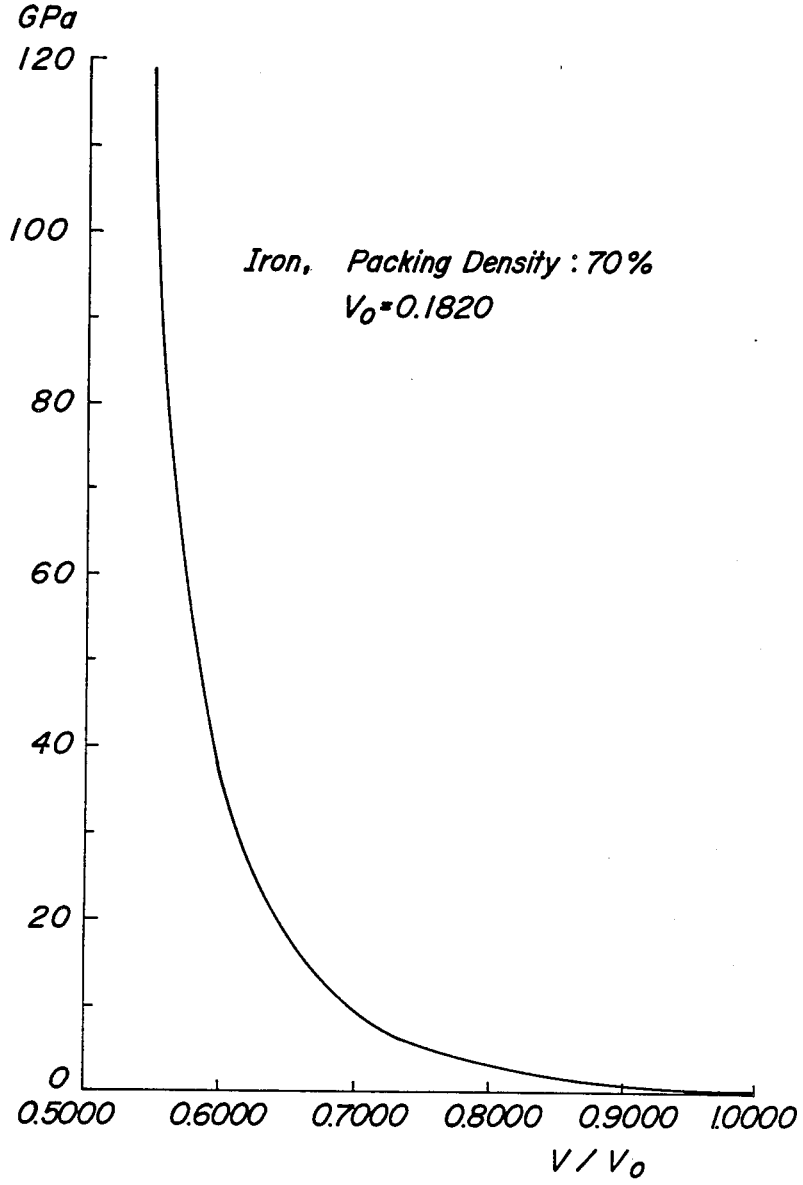
FIG. 7 is a specific volume-pressure curve of iron powders having a packing density percentage of 70%.
Figure 8:
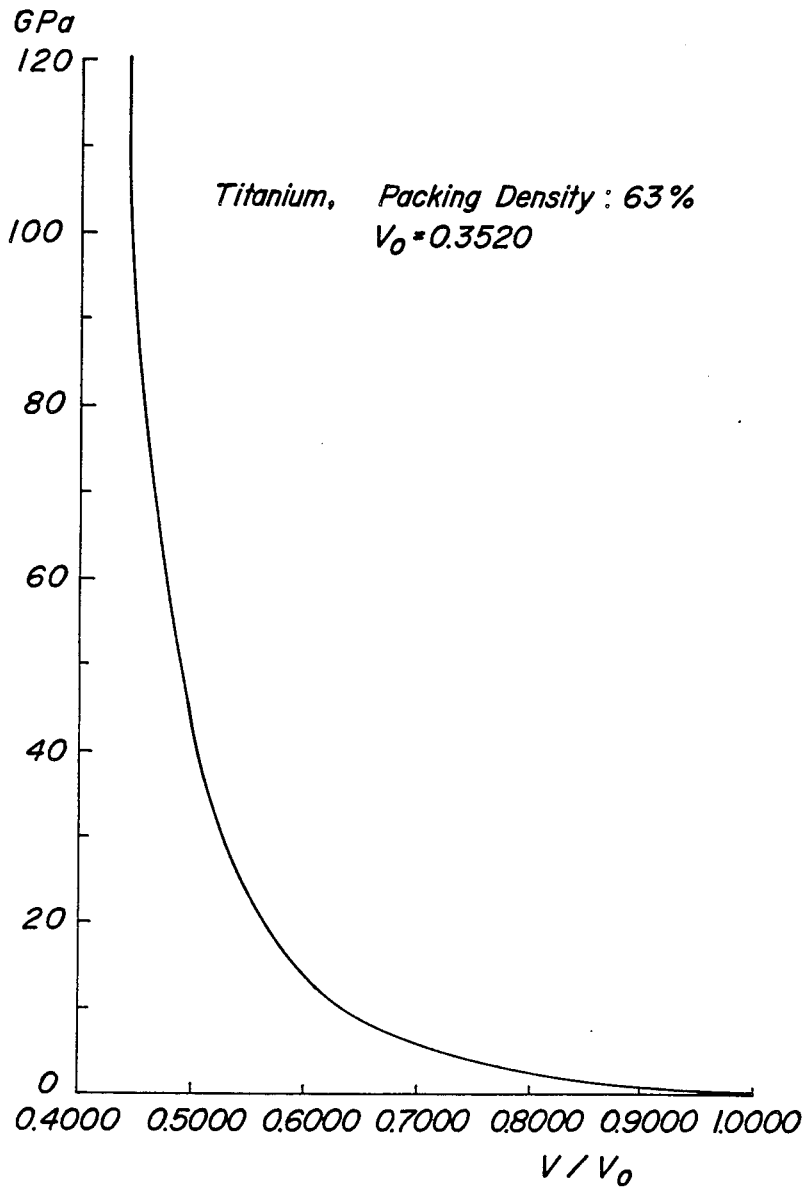
FIG. 8 is a specific volume-pressure curve of titanium powders having a packing density percentage of 63%.
Figure 9:
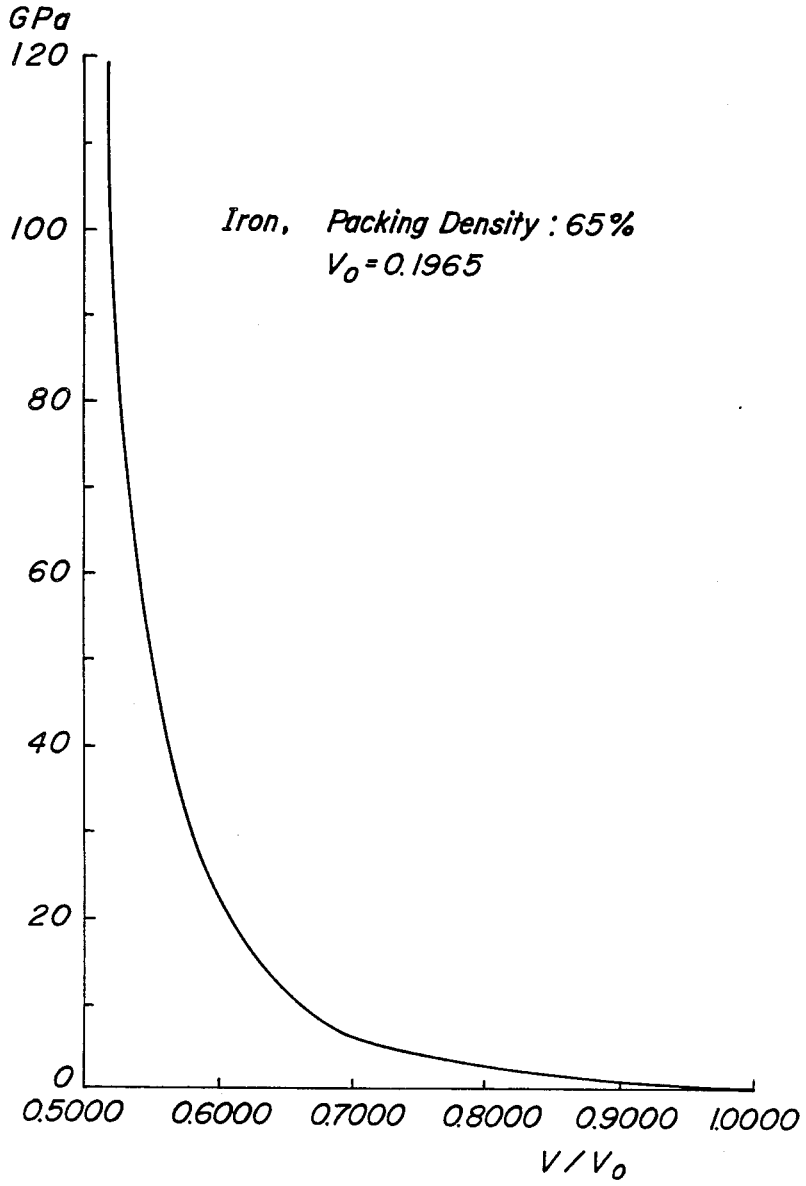
FIG. 9 is a specific volume-pressure curve of iron powders having a packing density percentage of 65%.

The specific volume-pressure curve of metal powders which are to be formed into a shaped article together with amorphous alloy powders, can be obtained from the shock characteristics under theoretical density of the metal in the same manner as described above. FIGS. 7, 8 and 9 are specific volume-pressure curves of iron powders having a packing density of 70% based on the density of iron, titanium powders having a packing density of 63% based on the density of titanium, and iron powders having a packing density of 65% based on the density of iron, respectively.

The shock wave velocity $U_s$ in a substance under an optical pressure can be determined from the above obtained specific volume-pressure curve of the substance. In this determination, there is used the following formula (7) obtained from formulae (1) and (2).

$$U_s = V_o[(P-P_o)/(V_o-V)]^{\frac{1}{2}} \quad (7)$$

In the formula (7), $$V_o = 1/\rho_o \text{ and } V = 1/\rho$$

An actual calculation of a shock wave velocity by using the specific volume-pressure curve and formula (7) will be explained. For example, when it is intended to calculate the shock wave velocity in a mass of iron-base amorphous alloy powders, which has a packing density of 71% based on the density measured by the Archimedes' method, and has a specific volume-pressure curve shown in FIG. 5 in the case where a shock wave under a pressure of 10 GPa is applied to the mass of the powders, the specific volume V of the iron-base amorphous alloy powders corresponding to 10 GPa in FIG. 5 is calculated to be 0.1278 cm$^3$/g from the specific volume-pressure curve. When $P_o=0$, $V=0.1278$ cm$^3$/g and $V_o=0.1908$ cm$^3$/g are substituted into formula (7), $U_s=2.404$ km/sec can be obtained.

The shock impedance before explained in the specification can be calculated from the above described shock wave velocity and the initial density of a substance. That is, the shock impedance S.I. is given by the following formula (8):

$$\text{S.I.} = \rho_o \cdot U_s = U_s/V_o \quad (8)$$

The shock impedance of the above described iron-base amorphous alloy powder mass is calculated to be as follows.

$$\text{S.I.} = 240{,}400 \text{ cm/sec} \div 0.1908 \text{ cm}^3/\text{g} = 1{,}260{,}000 \text{ g/sec.cm}^2$$

Comparison of thus obtained shock impedance with the shock impedance of metals, which have substantially no void, is as follows. Iron, copper and nickel have shock impedance of 3,265,000 g/sec.cm$^2$, 3,864,000 g/sec.cm$^2$ and 4,410,500 g/sec.cm$^2$ respectively under a pressure of 10 GPa. These shock impedances are 2.6 times, 3.1 times and 3.5 times that of the above described iron-base amorphous alloy powders, which have been packed in a packing density percentage of 71% based on their density measured by the Archimedes' method. When a shock wave is transmitted to powders having such high shock impedance after passed through amorphous alloy powders, the shock wave is necessarily reflected to cause rapid increase of pressure and to cause flaws, such as cracks and the like, in the amorphous alloy shaped article due to the above described mechanism. Moreover, when a pressure is increased in a certain portion, the portion necessarily has an internal energy higher than that in the other portion, and hence the former portion has a temperature higher than that in the latter portion, and crystallization occurs in the amorphous alloy portion near the contacting portion to the high shock impedance portion. All the amorphous alloy portions were crystallized in such portion as illustrated in Comparative examples in this specification also.

When a shock energy is applied to a laminated assembly of an amorphous alloy raw material powder layer and a metal powder layer, a reflected shock wave generated in the shock system interferes with a shock wave, which is introduced into the shock system from the exterior of the system, in the system to cause a rapid pressure rising at the interfered portion. When such interference of shock waves occur in the amorphous alloy raw material powder layer, the resulting amorphous alloy shaped article cracks due to the reason that amorphous alloy is brittle. Therefore, it is necessary to take care that such phenomenon does not occur.

Furthermore, when the packing density percentage of an amorphous alloy raw material layer or a metal powder layer is lower than a certain limit, the shock wave velocity $U_s$ and further the shock impedance S.I. can not be determined according to the above described method. Therefore, it is necessary to take care of the packing density percentages of the charged raw material powder layer and metal powder layer. This limit is a value defined by the following formula (9):

$$V_o/V_{op}<\gamma/(\gamma+2) \quad (9)$$

and indicating that the powders are packed in a very low packing density. When powders have been packed in a very low packing density so as to satisfy the condition defined by the above formula (9), it is necessary to handle the powders under an assumption that the specific volume-pressure curve of the powders rises uprightly at the value of specific volume $V_o$.

In an actual calculation, assuming that powders having an initial specific volume $V_{op}$ are compressed at most up to the initial specific volume $V_o$ of a solid having a theoretical density even in the case where pressure is changed, the $U_s$ and S.I. are calculated by the following formulae (10) and (11):

$$U_s=V_{op}[P/(V_{op}-V_o)]^{\frac{1}{2}} \quad (10)$$

$$\text{S.I.}=U_s/V_{op} \quad (11)$$

For example, when copper powders are packed in a packing density of 1.869 g/cm$^2$, which is 21% of the theoretical density of 8.9 g/cm$^3$ of copper, $\gamma_o$ is 2.0. Therefore, the value of formula (9) is calculated to be $$V_o/V_{op}=1.869/8.9=0.21<\gamma_o/(\gamma_o+2)=0.5$$

This value indicates the condition, wherein a specific volume-pressure curve rises uprightly, and hence $U_s$ and S.I. must be calculated by formulae (10) and (11). When P=10 GPa, $V_{op}=0.5350$ and $V_o=0.1124$ are substituted into formula (10), $U_s=2.602\times10^5$ cm/sec is obtained; and S.I.=486,360 g/sec.cm$^2$ can be obtained from formula (11).

When the thus obtained value of shock impedance is compared with the previously obtained value of shock impedance of the iron-base amorphous alloy powder mass having a packing density percentage of 71%, the shock impedance of copper powders having a packing density percentage of 21% corresponds to about 39% of the shock impedance of the iron-base amorphous iron alloy powder mass.

Based on the above described basic data, the inventors have made various theoretical and experimental investigations with respect to a combination of amorphous alloys and metals, both of which have various shock impedances, and as the result it has been found out that, when it is intended to produce a shaped article by a combination of amorphous alloy powders with metal powders, an excellent shaped article can be obtained in the case where the difference between the shock impedance of the amorphous alloy powders and that of the metal powders lies within the range of plus or minus 70% based on the shock impedance of the amorphous alloy powders.

For example, when the above described iron-base amorphous alloy powder mass having a shock impedance of 1,260,00 g/sec.cm$^2$ is used, metal powders having a shock impedance within the range of 378,000–2,142,000 g/sec.cm$^2$ is preferably used.

Of course, the shock impedance of metal having a theoretical density does not change. Therefore, the shock impedance of metal powders is adjusted by charging the powders in a vessel and controlling their packing density.

The present invention has been explained hereinbefore with respect to powdery amorphous alloy and powdery metal. However, in the present invention, amorphous alloy and metal having any shapes of fibrous shape, flaky shape, foamed body, calcined product of powders, and the like can be used similarly to the powdery amorphous alloy and powdery metal in so far as the alloy or metal contains voids uniformly and wholly dispersed therein.

It can be seen from the above explanation that, when the shock pressure changes, the shock wave velocity $U_s$ is changed and the shock impedance S.I. is necessarily changed. Moreover, different substances exhibit different specific volume-pressure curves, and therefore when the pressure used in the comparison of shock impedance between amorphous alloy powders and metal powders varies, the relation between the shock impedance of the amorphous alloy powder and that of the metal powder varies as well.

However, the shock pressure used in the production of amorphous alloy shaped articles is substantially within the range of from 5 GPa to 30 GPa, and it has been found from experiments that, when the relation between the shock impedance of the amorphous alloy powders and that of metal powders is selected such that the relation has the above described value under a pressure of 10 GPa, a good shaped article can be obtained. Accordingly, when it is intended to set the packing densities of amorphous alloy powders and metal powders, the aimed packing densities can be obtained by setting the shock impedances under 10 GPa of both the amorphous alloy powders and metal powders to necessary values.

In the present invention, a good amorphous alloy shaped article can be obtained by arranging laminately amorphous alloy powders and metal powders such that they are contacted with other, and applying a shock to the laminated powder assembly from the outside to press the assembly into a compact body. However, it is often practically difficult that these two kinds of powders are arranged so as to be contacted with each other at their boundary. In such case, a thin metal plate or an amorphous alloy foil may be arranged at the boundary of the powders as described above.

However, the partition naturally has a shock impedance higher than that of metal or amorphous alloy having voids therein, and therefore there is a risk in the use of the partition that, when a shock wave is arrived at the partition, the shock wave is reflected at the partition to generate a reflected shock wave having a pressure higher than that of the original shock wave, and to cause flaws, such as cracks and the like, in the resulting shaped article. In order to prevent the drawbacks, it is necessary to suppress the influence of the reflected shock wave as low as possible by using a partition having a thickness of not larger than 0.5 mm, preferably not larger than 0.1 mm, to make the acting time of the reflected shock wave as short as possible and to decrease the effective energy of the reflected shock wave as low as possible.

In the method for producing amorphous alloy shaped articles according to the present invention, a metal powder layer is laminately arranged on an amorphous alloy or atomized alloy raw material powder layer, and a high-energy shock pressure is applied to the laminated powder layer assembly, whereby the generation of a harmful reflected shock wave is suppressed as low as possible. Therefore, the resulting amorphous alloy shaped article does not contain flaws nor crystallized portions therein, and the method of the present invention has such a merit that an excellent amorphous alloy shaped article substantially free from flaws can be easily obtained by a simple operation.

When mixed particles having a specifically limited shape are used as amorphous alloy or atomized alloy raw material powders, a shaped article having a very high density can be obtained under a relatively low shock pressure.

The shaped article obtained by the method of the present invention can be worked into a final product and can be used in various fields. In the working, a metal layer formed together with the amorphous alloy layer is removed. Alternatively, when the formed metal layer can be contained in the final product, the amorphous alloy layer is worked together with the metal layer.

The use of the shaped article is as follows. The amorphous alloy shaped article can be widely used as magnetic materials for various magnetic sensors, magnetic head, magnetic shield material, magnetic core and the like; as materials having high hardness and strength; and as a corrosion-resistant material. When atomized alloy powders produced by a rapid cooling method is used as raw material powders, the resulting shaped article can be widely use as a material having high hardness and strength, a corrosion-resistant material, and the like.

The present invention will be explained referring to the following examples and comparative examples.

EXAMPLE 1

A recess having a diameter of 15 mm and a depth of 10 mm was formed in the center of an SS41 steel disc having a diameter of 127 mm and a thickness of 50 mm, and commercially available electrolytic iron powders having a particle size of less than 100 mesh size were first charged in the recess in a thickness of 5 mm. The charged amount of the electrolytic iron powders was 4.5 g, and the packing density percentage of the charged electrolytic iron powders was 69.4% based on the theoretical density of the powders. The charged iron powders has a shock impedance of 1,159,000 g/sec.cm$^2$ under a pressure of 10 GPa.

Then, a homogeneous mixture of 80% by weight of iron-base amorphous alloy raw material powders having a particle size within the range of from 125 μm to 44 μm and having a center value of 85 μm in the particle size distribution and 20% by weight of iron-base amorphous alloy raw material powders having the same composition as that of the above described iron-base alloy powders and having a particle size within the range of from 20 μm to 4 μm and having a center value of 12 μm in the particle size distribution was charged into the recess up to its upper edge.

The composition of above described iron-base amorphous raw material powders consists, in % by weight, of 75% of iron, 15% of boron and 15% of silicon, and microscopical observation of the raw material powders showed that the ratio of the average value of the maximum dimensions to the average value of the minimum dimensions of the particles of the powders was 1.6:1. The amount of the raw material powders charged in the recess was 4.63 g, and the charged raw material powders had a packing density percentage of 71% based on 7.38 g/cm$^3$ of the density of the powders measured by the Archimedes' method (thereinafter, the "density measured by the Archimedes' method" may be referred to as "Archimedes' density"). The raw material powders having the packing density percentage had a shock impedance of 1,360,410 g/sec.cm$^2$ under a pressure of 10 GPa. A comparison under the same pressure of this shock impedance of the raw material powders with the shock impedance of the above described electrolytic iron powders having the packing density percentage of 64.9% showed that the shock impedance of the electolytic iron powders was about 85% based on the shock impedance of the raw material powders.

Then, the upper surface of charged raw material powder layer was covered with a steel sheet of 1 mm thickness, and further a steel sheet having a diameter of 80 mm and a thickness of 3.2 mm was arranged at a position 20 mm above the above described thin steel sheet in parallel with the former steel sheet by supporting the peripheral portion of the latter steel sheet by a paper board, and a disc-shaped explosive having the same diameter as that of the latter steel sheet and a thickness of 20 mm was arranged on the latter steel sheet, and the explosive was detonated in an explosion sound suppressing chamber by means of a plane wave generator to generate a plane wave detonation.

As the result, the steel sheet having a thickness of 3.2 mm was projected by the explosion pressure, and collided, while keeping its plane shape, with the thin steel sheet of 1 mm thickness, which had been arranged on the raw material powder layer so as to cover the powder layer. The collision speed of the thin steel sheet was measured by the pin-contact method, and was found to be 1.4 km/sec. When the pressure which has been applied to the raw material powder layer in the treatment was determined by the impedance match method by using the collision speed, the specific volume-pressure curve of steel powders and the specific volume-pressure curve of iron-base amorphous alloy powders shown in FIG. 5, the pressure was found to be 27 GPa. In this collision, the shock impedance of the raw material powder layer was 2,030,210 g/sec.cm$^2$, and that of the electrolytic iron powder layer was 1,830,470 g/sec.cm$^2$.

When the shock pressure was applied to the recess containing the raw material powder layer and metal powder layer, the recess was kept under vacuum in order to suppress the influence of atmosphere as low as possible, and further the raw material powders and metal powders were previously heated at 300° C. under vacuum to remove gases adsorbed to the powders.

In the recovered shocked system, the steel disc containing the raw material powder layer and electrolytic iron powder layer therein was distorted and cracked by the shock. However, the resulting shaped article formed in the steel disc had a compact structure, wherein fellow particles were bonded, and cracks were not formed on the bonding surface of the raw material alloy powder layer and the electrolytic iron powder layer. Although the resulting shaped article had some cracked portions on each of the upper surface and lower surface, when the cracked portions were ground and removed, there was obtained a good shaped article having a diameter of 13.8 mm, consisting of an amorphous alloy layer of 2.8 mm thickness and an electrolytic iron layer of 2.9 mm, and having an appearance without any flaws, such as cracks, voids and the like.

When the shaped article was cut off by means of a cutting-off wheel, and the cross-section was observed by a microscope, fellow particles were substantially completely bonded with each other, and the boundary of fellow particles was not substantially observed. Further, it was found that the amorphous alloy layer and the electrolytic iron layer were monolithically bonded with each other without forming crevices at the bonded surface. The resulting shaped article was cut into two halves, and one of the two halves was subjected to a cutting treatment to remove the electrolytic iron layer only, and the other was subjected to a cutting treatment so as to remove the amorphous alloy layer and to leave the electrolytic iron layer. The former half consisting of the amorphous alloy had an Archimedes' density of 7.35 g/cm$^2$, which was 99.6% of its theoretical density. The latter half consisting of the electrolytic iron had an Archimedes' density of 7.83 g/cm$^2$, which was 99.7% of its theoretical density. When the boundary of the amorphous alloy layer and the electrolytic iron layer of the shaped article was etched with a methanol solution containing 10% by weight of 35% nitric acid, and the etched boundary portion was observed by means of a microscope of 400 magnifications, there were no crystallized portions in the amorphous alloy layer.

An X-ray diffractometry of the resulting amorphous alloy showed that the amorphous alloy had an X-ray diffraction pattern consisting only of halopatterns, and the regular structure of atoms was not observed even in an observation by a high-resolution electron microscope. Therefore, an amorphous state is maintained in the amorphous alloy layer in the resulting shaped article.

Further, a measurement of the hardness of the amorphous alloy showed that Vickers hardness of about $H_v=900$ was obtained in all the measured points in the amorphous alloy layer. This fact also shows that the amorphous alloy layer of the shaped article maintains an amorphous state and has a very high hardness as a metal.

Then, a ring-shaped amorphous alloy layer having an outer diameter of 13.8 mm, an inner diameter of 7.0 mm and a thickness of 1.0 mm was cut out from the same amorphous alloy piece used in the above described test, and the magnetic properties of the amorphous alloy layer was measured by using the ring. It was found that the amorphous alloy layer had a flux density of $B_{10}=11.5$ KG in a magnetic field of 10 Oe, and a flux density of $B_{50}=15.0$ Kin a magnetic field of 50 Oe and a coercive force of $H_c=0.3$ Oe. Therefore, the amorphous alloy portion of the shaped article is a very excellent bulky amorphous alloy shaped article. This fact is probably due to the reason that the amorphous alloy shaped article has a very high density and is very few in flaws, such as fine cracks and the like.

COMPARATIVE EXAMPLE 1

An experiment was carried out in the same manner as described in Example 1, except that the same iron-base amorphous alloy raw material powders are used in Example 1 alone were charged in the recess in place of the use of the iron-base amorphous alloy raw material powders and the metal powders. That is, 9.32 g of the raw material powders were charged in a recess having a diameter of 15 mm and a depth of 10 mm. The charged raw material powders had a packing density percentage of about 71% based on the theoretical density of the powders.

After a deaeration treatment and a vacuum treatment of the raw material powders were effected in the same manners as described in Example 1, the raw material powder layer was subjected to a shock treatment in the same manner as described in Example 1. The steel disc was distorted and cracked due to the shock, but a shape article having a compact structure was obtained. The shaped article had cracks and incompletely shaped portions scattered on the periphery of the article, and further had a large crack on the surface of the side reverse to the side exposed to the shock, that is, on bottom surface of the shaped article, said bottom surface being faced to the bottom of the recess, which crack was extending in parallel to the bottom surface of the shaped article at a position 1.3–2.0 mm distant from the bottom surface.

When the portion of the shaped article, which ranges from the cracked portion to the bottom surface of the shaped article, was removed and further the incompletely shaped portion and irregularly shaped portion on the peripheral portion and surfaces of the shaped article were removed by grinding to produce a disc consisting only of a good shaped article portion. The resulting disc had a diameter of 12.8 mm and a thickness of 3.2 mm.

The ratio in percentage of the Archimedes' density of the above obtained amorphous alloy disc to its theoretical density was found to be 99.3%, which was 0.3% lower than the ratio in percentage of 99.6% of the Archimedes' density of the amorphous alloy disc obtained in Example 1 to its theoretical density. The total weight of the above obtained disc-shaped article was 3.02 g, which was 32.7% based on the amount of the raw material powders before the forming.

Accordingly, the yield of a shaped article from amorphous alloy raw material powders in Comparative example 1 is less than one half of the yield of 66.5% of the amorphous alloy shaped article portion in example 1, and it is clear that the present invention is superior to a conventional method in the yields of not only the whole body of shaped article, but also the excellent amorphous alloy portion.

In Example 1, the electrolytic iron powder layer arranged adjacently to the amorphous alloy raw material powder layer had a shock impedance similar to that of the amorphous alloy raw material powder layer. On the contrary, in Comparative example 1, amorphous alloy raw material powders charged in the recess had a shock impedance of 1,306,410 g/sec.cm$^2$ under a pressure of 10 GPa, but the steel of the bottom of the recess had a shock impedance of 3,267,170 g/sec.cm$^2$, which was as high as 150% higher than the shock impedance of the amorphous alloy raw material powders charged in the recess. Therefore, flaws were formed in the shaped article probably due to the reason that the reflection of shock wave at the interface was very large not to be ignored.

When the shaped article was etched and the etched surface was observed by means of a microscope in the same manners as described in Example 1, crystals were observed in a region from the surface of the shaped article to the depth of about 200 μm.

Further, when the shaped article was observed by the X-ray diffractometry, peaks indicating the formation of crystals were observed. Moreover, an observation of the shaped article by means of a high-resolution electron microscope showed that the shaped article had a regular structure of atoms.

Then, a part of the shaped article was worked into a ring having an outer diameter of 12.8 mm, an inner diameter of 6.0 mm and a thickness of 1.0 mm, and the magnetic properties of the shaped article were measured by using the ring. It was found that the shaped article had magnetic properties of $B_{10}=4.9$ KG, $B_{50}=7.2$ KG and $H_c=2.7$ Oe, which were considerably inferior to those of the amorphous alloy portion of the shaped article in Example 1. The reason is probably due to the influence of flaws, such as cracks and the like, formed in the interior of the shaped article and to the influence of crystals formed in the shaped article.

EXAMPLE 2

The following experiment was carried out according to the method illustrated in FIG. 1

A partition made of a nickel-base amorphous alloy foil, having a hollow cylindrical shape and having a length of 120 mm and a diameter of 12 mm, was previously arranged in the center portion of a copper tube having an outer diameter of 25 mm, a thickness of 2 mm and a length of 200 mm. Nickel-base amorphous alloy raw material powders, consisting of a homogeneous mixture of 50% by weight of nickel-base amorphous alloy powders having a particle size ranging from 88 μm to 44 μm and a center value of 66 μm in the particle size distribution and 50% by weight of nickel-base amorphous alloy powders having a particle size ranging from 10 μm to 3 μm and having a center value of 7 μm in the particle size distribution, were charged into the copper tube over a range of 100 μm in its center portion in its length direction so as to surround the amorphous alloy foil hollow cylindrical partition and to form a nickel-base amorphous alloy raw material powder layer having a hollow cylindrical shape surrounding the partition and having an inner diameter of 12 mm, an outer diameter of 21 mm and a length of 100 mm. The amorphous alloy foil hollow cylindrical partition was produced by winding a nickel-base amorphous foil having a width of 50 mm and a thickness of 35 μm into a hollow cylindrical shape by overlapping the edges in a width of about 3 mm, and adhering the overlapped portion by means of a cellulose adhesive. Electrolytic iron powders having a particle size of less than 100 mesh size were filled in the inside of the hollow cylindrical partition. Further, the same iron powders as described above were charged in the copper tube at the spaces ranging from both ends of the portion, wherein the amorphous alloy raw material powders and the electrolytic iron powders were charged, to its both ends, and steel plugs having a length of 20 mm and a diameter of 21.2 mm were forcedly pressed into both ends of the copper tube to seal the ends. A hole having a diameter of 2 mm was formed at the axial center of one of the steel plugs, and a sintered graphite round rod having an apparent density of 1.5 g/cm$^3$, a length of 5 mm and a diameter of 2 mm was inserted into the hole, and an evacuating copper pipe having an outer diameter of 10 mm, an inner diameter of 8 mm and a length of 80 mm was brazed with brass to the outer surface of the steel plug at a position, wherein the evacuating copper pipe was aligned with the center axis of the copper tube containing the amorphous alloy raw material powders and electrolytic iron powders, such that the interior of the copper tube was able to be made into vacuum in the case where a shock pressure was applied to the laminately arranged amorphous alloy raw material powders and electrolytic iron powders contained in the copper tube to press the powders into a compact body. The boundary of the steel plug and the copper tube was brazed with brass as well for the same purpose.

The nickel-base amorphous alloy raw material powders charged in the copper tube had a composition consisting of 75% by weight of nickel, 15% by weight of boron and 10% by weight of silicon, and had a density of 7.835 g/cm$^3$ measured by the Archimedes' method. The amount of the raw material powders charged over a 100 mm length in the center portion of the copper tube was 133.42 g, and the charged raw material powders had a packing density percentage of 73% based on their Archimedes' density. The packing density percentage of 73% of the raw material powders based on their Archimedes' density corresponds to a packing density percentage of 64% of the powders based on the theoretical density of nickel. Therefore, when it was intended to determine a specific volume-pressure curve of the raw material powders under an assumption that the raw material powders contained voids similarly to Example 1, a specific volume-pressure curve illustrated in FIG. 6 was used in the calculation of the shock properties of the raw material powders.

The packing density of the electrolytic iron powders was 70% based on the theoretical density of iron. The nickel-base amorphous alloy raw material powders charged in the above described packing density percentage of 64% based on the theoretical density of nickel had a shock impedance of 1,487,040 g/sec.cm$^2$ under a pressure of 10 GPa, and the electrolytic iron powders charged in the packing density percentage of 70% based on the theoretical density of iron had a shock impedance of 1,280,560 g/sec.cm$^2$ under a pressure of 10 GPa. That is, the shock impedance value of the electrolytic iron powders was 14% lower than that of the nickel-base amorphous alloy raw material powders.

The nickel-base amorphous alloy foil arranged between the raw material powders and the electrolytic iron powders had a composition consisting of 92.3% by weight of nickel, 3.2% by weight of boron and 4.5% by weight of silicon, and had a density of 7.97 g/cm$^3$.

Into a steel tube having an outer diameter of 76.3 mm, a thickness of 4.2 mm and a length of 300 mm was previously charged 922 g of a powdery explosive having a detonation velocity of 2,300 m/sec. The above described copper tube containing the nickel-base amorphous alloy raw material powders and the electrolytic iron powders and being used as a pressing tube was embedded in the explosive on the center axis of the steel tube such that one end of the copper tube was located at a position 70 cm distant from the end of the steel tube, at which end the explosive in the steel tube was exposed to air, and an electric blasting cap was fitted to the end of the steel tube at its center portion, and the explosive was detonated in an explosive sound suppressing chamber. In this case, air in the copper tube had previously been removed by means of a vacuum pump through the evacuating copper pipe having a diameter of 10 mm, which pipe had previously been fitted to the copper tube. Further, the gas adsorbed to the amorphous alloy raw material powders and an electrolytic iron powders had previously been removed in the same manner as described in Example 1.

The pressing copper tube containing the amorphous alloy raw material powders and electrolytic iron powders was pressed from the surroundings by the action of explosion pressure, and as the result the outer diameter of the tube was shrunk. When the copper tube was cut and removed by means of a lathe, the amorphous alloy powders and the electrolytic iron powders had been bonded into a compact shaped article. When the shaped article was cut off in a direction perpendicular to its center axis by means of a cutting-off wheel, and the section was observed by a naked eye, it was found that the outer layer formed of amorphous alloy layer and the inner layer formed of electrolytic iron layer were tightly bonded with each other without forming crevices and cracks. Moreover, in the center portion of the shaped article, wherein the charged electrolytic iron powders had been compressed, a cavity having an irregular but substantially tubular shape and having a diameter of 1–2.3 mm had been formed in parallel with the axis of the shaped article. In the electrolytic iron layer surrounding the cavity, iron powders are tightly bonded to each other, and flaws such as cracks, voids and the like, were not at all observed.

When the section was polished into a mirror surface by means of a polishing cloth, and the polished surface was etched by means of a methanol 90/35% nitric acid 10 (volume %) solution, and the etched surface was observed by an optical microscope of 400 magnifications, the outer layer formed of amorphous alloy had a good formed state, wherein the boundary of particles was not substantially observed, and crystals were not at all observed. Further, the boundary of the inner layer formed of electrolytic iron layer and the outer layer formed of amorphous alloy layer and the shaped article portion formed of the electrolytic iron layer had a good formed state, and cracks and cavities were not observed with the exception of the cavity formed in the center portion of the shaped article. Of course, in the outer layer portion consisting of formed amorphous alloy powders in the shaped article, cracks and cavities were not at all observed, and it was found that the presence of the amorphous alloy foil arranged between the amorphous alloy powder layer and the electrolytic iron powder layer had not an adverse influence upon the formation of the shaped article. However, voids and irregularly and unsatisfactorily formed portions were observed in the boundary portion of the amorphous alloy layer and the copper tube at the peripheral portion of the shaped article. The outer diameter of the amorphous alloy outer layer inclusive of such unsatisfactorily formed portion was about 18 mm. When the shaped article having such unsatisfactorily formed portion was worked into a shaped article consisting only of a shaped article portion having a good formed state by removing the unsatisfactorily formed portion on the surface of the amorphous alloy outer layer through grinding, the resulting shaped article had an outer diameter of 16.8 mm.

The outer diameter of the inner layer formed of electrolytic iron layer, that is, the diameter of the boundary of the inner and outer layers was about 10 mm. The resulting shaped article was ground and worked into two cylinders, one of which consisted only of the amorphous alloy portion, and the other of which consisted only of the electrolyte iron portion. When the densities of the amorphous alloy portion and the electrolytic iron portion were measured by the Archimedes' method, it was found that the density of the amorphous alloy portion was 7.819 g/cm$^3$ and that of the electrolytic iron portion was 7.842 g/cm$^3$.

These densities correspond to 99.8% and 99.9% of their theoretical densities, respectively.

In another experiment, when the shape of a shock wave which transmits through the amorphous alloy powders and the electrolytic iron powders, was measured, it was found that the shock wave had a shape illustrated in FIG. 2. When the shock pressures generated in the amorphous alloy powders and in the electrolytic iron powders were measured by applying the condition that a shock pressure is obtained by a component of shock wave, which component is perpendicular to the shock front, and the specific volume-pressure curves shown in FIGS. 6 and 7 to the above obtained result, it was found that the shock pressure generated in the amorphous alloy powders was 9.45 GPa and the shock pressures generated in the electrolytic iron powders were 9.71 GPa at the portion of the shock wave perpendicular to the proceeding direction of explosion, and 9.45 GPa at the portion of the shock wave oblique to the proceeding direction of explosion. The shock impedance of the amorphous alloy powders was 1,447,990 g/sec.cm$^2$, and the shock impedances of the electrolytic iron powders were 1,262,630 g/sec.cm$^2$ at a portion of the shock wave perpendicular to the proceeding direction of explosion and 1,247,240 g/sec.cm$^2$ at a portion of the shock wave oblique to the proceeding direction of explosion.

COMPARATIVE EXAMPLE 2

An experiment was carried out in the same manner as described in Example 2, except that the same amorphous alloy raw material powders as used in Example 2 alone were charged into the pressing copper tube in place of charging concentrically the amorphous alloy raw material powders and the electrolytic iron powders into the copper tube.

The charged amount of the amorphous alloy raw material powders was 198.1 g, and the charged raw material powders had a packing density percentage of 73% based on their density measured by the Archimedes' method.

After an explosion shock was applied to the amorphous alloy raw material powders, the resulting shaped article was recovered. The resulting shaped article had the same shape as the shaped article obtained in Example 2, but had the following defects. That is, when the copper tube was removed, and the shaped article was cut off, and then the section perpendicular to the center axis of the shaped article was examined, a cavity having an irregular shape and having a diameter of 2–3.5 mm was observed in the center portion of the shaped article, and radial cracks extended irregularly in the shaped article from the cavity.

The cracked portion of the shaped article was ground and removed from the shaped article to obtain that portion of the shaped article which did not contain cracks nor voids and was judged to be satisfactorily formed. The resulting shaped article containing no cracks and the like had a density of 7.792 g/cm$^3$ measured by the Archimedes' method. This value corresponds to 99.5% of the theoretical density of the amorphous alloy, and was 0.3% lower than the percentage of 99.8% of the Archimedes' density of the amorphous alloy portion of the shaped article obtained in Example 2 to the theoretical density of the amorphous alloy. The shaped article having no cracks and the like and being judged to be good had a weight of 33.8 g, and the yield of the shaped article based on the amount of raw material powders was as low as only 17.1%. While, in Example 2, when the weight of the amorphous alloy portion of the shaped article was deduced from the outer shape of the whole body of the shaped article finally obtained and judged to be free from flaws, and the yield of the amorphous alloy portion was calculated, the yield was calculated to be not less than 88%. Therefore, the yield of 17.1% in this Comparative example 2 is very low as compared with the yield of not less than 88% in Example 2.

When the shaped article was observed at the peripheral portion of the cavity by a microscope in the same manner as described in Example 1, crystals were formed in a depth within the range of 300–900 μm in the shaped article at the peripheral portion of the cavity.

The shaped article in Example 2 is very small in the size of cracks and voids and has a very excellent bonded state as compared with the shaped article in Comparative example 2, and further is higher in the density than the shaped article in Example 1.

In an X-ray diffractometry of the shaped articles obtained in Example 2 and Comparative example 2 in order to examine the amorphous property of the shaped articles, the amorphous alloy portion of the shaped article of Example 2 had an X-ray diffraction pattern consisting only of halopatterns, but the amorphous alloy shaped article of Comparative example 2 had peaks indicating the presence of crystal. Further, in the microscopical observation by means of a high-resolution electron microscope, the former had only a random structure of atoms, but the latter had a regular arrangement of atoms. It can be judged from the results that, even after the formation, the former still has an amorphous state, while in the latter, crystallization occurs.

EXAMPLE 3

The following experiment was carried out according to the method illustrated in FIG. 3.

Commercially available steel sheets having a thickness of 1.6 mm were welded to each other at their edge portion to produce a box having a depth of 15 mm, a width of 50 mm and a length of 150 mm, each being inside dimension, and having an open upper surface. Amorphous alloy raw material powders, which had the same composition as that of the amorphous alloy foil used in Example 2 and had a particle size smaller than 140 mesh size, were charged in the box at the center portion of the bottom in a depth of 5 mm, a width of 30 mm and a length of 80 mm. In this case, a partition produced from the same amorphous alloy foil as used in Example 2 was previously arranged uprightly in the steel box such that the amorphous alloy raw material powders could be arranged in a proper shape.

On the charged raw material powders, flaky titanium powders having a particle size smaller than 100 mesh size were arranged in a thickness of 5 mm. Further, on the titanium powders, the same amorphous alloy powders as those charged in the bottom of the box were charged in a thickness of 5 mm, whereby the upper surface of the charged powders was agreed with the upper edge of the box. That is, in a steel box having no upper cover, a partition was produced from an amorphous alloy foil, and further a three-layered sandwich-like powder layer consisting of amorphous alloy powders-titanium powders-amorphous alloy powders was formed inside the partition.

Further, titanium powders were filled in a space formed outside the partition, that is, in a space between the inner wall of the steel box and the amorphous alloy foil partition, which surrounds the three-layered powder layer, and a cover made of steel and having a thickness of 1.6 mm, a width of 53 mm and a length of 153 mm, was arranged on the box, and the edge portion of the box was sealed by an adhesive tape made of polyvinyl chloride, and further gaps formed in the edge portion were sealed by a vacuum grease, whereby the interior of the box was kept airtight.

An evacuating copper pipe, which was the same as the evacuating copper pipe fitted to the steel plug in Example 1, was brazed to the steel box such that the interior of the box was able to be made into vacuum in the case where an explosion pressure was applied to the three-layered powder layer to press the powder layer into a compact body.

Under the above described charged state, the charged amorphous alloy powders had a packing density of 77.5% based on their theoretical density, and the charged titanium powders had a packing density of 63% based on the density of 4.51 g/cm$^3$ of titanium having no voids.

It was found from a calculation that, under the above described charged state, the amorphous alloy powders had a shock impedance of 1,392,170 g/sec.cm$^2$ and the titanium powders had a shock impedance of 836,714 g/sec.cm$^2$, under a pressure of 10 GPa. That is, the shock impedance of the titanium powders is about 40% lower than that of the amorphous alloy powders.

The interior of the box was deaerated by means of a rotary vacuum pump to keep the vacuum degree in the interior of the box to $10^{-2}$ Torr, and the evacuating copper pipe was sealed, and then an explosion shock was applied to the box. Both the amorphous alloy raw material powders and the titanium powders had previously been subjected to a treatment for removing gases absorbed to the powders before the powders were charged into the box in the same manner as described in Example 1.

FIG. 3 illustrates a method for applying an explosion shock to the box. As illustrated in FIG. 3, steel sheets having a thickness of 1.6 mm, a width of 130 mm and a length of 200 mm were arranged on the upper side and lower side of the shorter edges of the steel box such that one surface of each steel sheet was faced to the upper or lower surface of the steel box and was inclined at an angle of 10° with respect to the upper or lower surface of the box, and an explosive having a detonation velocity of 4,200 m/sec was stuck to another surface of the steel sheets in a thickness of 15 mm, which surface was not faced to the upper or lower surface of the box, over the whole area of the steel sheets, and further another explosive, which was the same kind as the above described explosive and had a cross-sectional shape of 30 cm square and a length of 130 mm, was arranged such that the explosive would contact with the above described two explosives. An electric blasting cap was fitted to the center portion of the latter explosive, and the explosive was detonated, whereby the total explosives were exploded.

When the explosives were exploded, the steel sheets contacted with the explosives collided at high speed with the box at the surfaces faced the steel sheets, and successively collided with the surfaces of the box with the proceeding of explosion. FIG. 4 illustrates the process of collision of the steel sheets with the surfaces of the box. In FIG. 4, the reference $V_c$ represents the proceeding velocity of colliding portion. In this example, the velocity $V_c$ was 2,640 m/sec.

The steel box containing the amorphous alloy powders and titanium powders was completely broken and flown away by the explosion shock applied thereto, except that a part of the steel sheets were bonded to the resulting shaped article. The shaped article was recovered in a state substantially free from damage, except that cracks were observed in the peripheral portion of the titanium layer, which were extending in parallel to the edge of the outer periphery of the titanium layer at a position 5–8 mm distant from the edge, and further a part of the edge was broken in the form of 3–5 mm square.

Moreover, very small voids and chaps were observed in the shaped article at the portions, wherein the amorphous alloy powders had been contacted with the bottom of the box and with the under surface of the cover. However, when the shaped article was cut off in a direction perpendicular to its longer edge, and the section was observed by a naked eye or a microscope, the amorphous alloy layer and the titanium layer were tightly bonded with each other, and there were neither cracks nor voids in both layers. When the amorphous alloy layer portion and the titanium layer portion were separately cut out from the shaped article, and the densities of both portions were measured by the Archimedes' method, both portions had a density of 99.7% based on their theoretical density. When the boundary of the amorphous alloy layer and the titanium layer was examined in the same manner as described in Example 1, crystallization of the amorphous alloy layer was not at all observed.

COMPARATIVE EXAMPLE 3

An experiment was carried out in the same manner as described in Example 3, except that an amorphous alloy powder layer was arranged between titanium powder layers contrary to Example 3, wherein a titanium powder layer was arranged between amorphous alloy powder layers.

As the result, a large crack was formed in the resulting shaped article at the middle portion of the thickness of the amorphous alloy layers. Due to the presence of the crack, the shaped article was broken into two pieces and recovered in the form of two shaped articles having substantially the same volume.

A section perpendicular to the surface of each shaped article was observed by a naked eye and a microscope. As the result, a large number of cracks were observed penetrating through the amorphous alloy layer and extending to the titanium layer in both shaped articles, and the shaped articles were estimated to be practically unusable.

The reason why such poor shaped article was formed is probably as follows. Shock waves, which have been penetrated into the laminated powder layer assembly from its both surfaces, collide with each other in the amorphous alloy powder layer to cause an abrupt rising of shock pressure and to cause a large stress in the amorphous alloy layer, and as the result the brittle amorphous alloy layer can not resist the large stress, resulting in the formation of the crack. Moreover, in each of the two broken amorphous alloy portions, crystallized portions were observed in a depth ranging from 300 μm to 800 μm, but crystallized layers were not observed at the boundary of the amorphous alloy layer and the titanium layer.

EXAMPLE 4

An experiment was carried out in the same manner as described in Example 3, except that atomized SKH 9 steel powders produced by a rapid cooling method were used in place of the amorphous alloy powders used in Example 3 and a thin titanium plate having a thickness of 0.3 mm was used as a partition in place of the amorphous alloy foil used in Example 3.

As the atomized SKH 9 steel powders, there was used a mixture of atomized SKH 9 steel powders having an average particle size of about 120 μm and having a particle size distribution ranging from 30 μm to 250 μm and atomized SKH 9 steel powders having an average particle size of about 15 μm and having a particle size distribution ranging from 6 μm to 30 μm in a mixing ratio (in weight ratio) of 2:1. The mixed atomized powders had a density of 7.95 g/cm$^3$ measured by the Archimedes' method, and had a density of 5.10 g/cm$^3$ in the charged state in the steel box.

Accordingly, the density of the atomized powders in the charged state corresponds to 65% of the theoretical density of the steel. Therefore, in the calculation of the shock impedance of the amorphous alloy powders, a specific volume-pressure curve of iron having a packing density percentage of 65% (shown in FIG. 9) was used. In this case, the atomized powders have a shock impedance of 1,161,030 g/sec.cm$^2$ under a pressure of 10 GPa, and titanium powders having a packing density percentage of 63% have a shock impedance of 836,714 g/sec.cm$^2$ under a pressure of 10 GPa, that is, the shock impedance of the titanium powders is about 28% lower than that of the atomized powders.

A shaped article was produced by applying a shock to the laminated powder layer assembly in the same manner as described in Example 3, and the resulting shaped article was cut off in a direction perpendicular to the major axis of the shaped article, and the section was observed by a naked eye and a microscope with respect to the SKH 9 steel outer layer and to the titanium inner layer of the shaped article. It was found that the SKH 9 steel layer was tightly bonded to the titanium layer, and neither cracks nor voids were observed in both layers. The SKH 9 steel portion and titanium portion were separately cut out, and the density of each portion was measured by the Archimedes' method. It was found that the SKH 9 steel portion had a density of 99.4% based on the theoretical density of the SKH 9 steel, and the titanium portion had a density of 99.7% based on the theoretical density of titanium.

COMPARATIVE EXAMPLE 4

An experiment was carried out in the same manner as described in Example 4, except that the atomized SKH 9 steel powders and titanium powders were arranged in the reverse order to the order in Example 4.

As the result, a large crack was formed in the resulting shaped article at the middle portion of the inner layer consisting of SKH 9 steel. Due to the presence of the crack, the shaped article was broken into two pieces and recovered in the form of two shaped articles having substantially the same volume.

A section perpendicular to the surface of each shaped article was observed by a naked eye and a microscope.

As the result, a large number of cracks were observed penetrating through the SKH 9 steel layer and extending to the titanium layer in both shaped articles, and the shaped articles were estimated to be practically unusable.

The reason why such poor shaped article was formed is probably as follows. Shock waves, which have been penetrated into the laminated powder layer assembly from its both surface, collide with each other in the SKH 9 steel powder layer to cause an abrupt rising of shock pressure and to cause a large stress in the SKH 9 steel layer, and as the result the brittle SKH 9 steel layer can not resist the large stress, resulting in the formation of the cracks.

EXAMPLE 5

An experiment was carried out in the same manner as described in Example 2, except that electrolytic copper powders were used in place of the electrolytic iron powders used in Example 2. The packing density of the electrolytic copper powders was 1,869 g/cm$^3$, which was 21% based on the theoretical density of copper. In this case, the shock impedance value of the charged amorphous alloy powders, and that of the charged electrolytic copper powders, and the ratio in percentage of the shock impedance value of the amorphous alloy powders to that of the copper powders are the values already explained in this specification.

An amorphous alloy foil was not used in the boundary between the amorphous alloy powder layer and the electrolytic copper powder layer, but the electrolytic copper powders were embedded in the amorphous alloy powders in the following manner. That is, the electrolytic copper powders were agglomerated into a round rod by the use of about 10% by weight, based on the amount of the copper powders, of polyvinyl alcohol as a binder, and the round rod consisting of the copper powders agglomerated together with the polyvinyl alcohol was arranged in the center portion of the same steel tube as described in Example 2, the same amorphous alloy raw material powders as used in Example 2 were charged in the steel tube so as to surround the round rod, and the assembly was subjected to a deaeration treatment to decompose and remove the polyvinyl alcohol, whereby the electrolytic copper powder layer was formed inside the annular amorphous alloy raw material powder layer without arranging the amorphous alloy foil between both the powder layers.

The shaped article obtained by applying a shock pressure to the laminated powder layer assembly was a good shaped article free from cracks, void and crystallized portions in the amorphous alloy layer similarly to the shaped article obtained in Example 2, except that the diameter of metal portion is smaller than that of the metal portion in the shaped article of Example 2 due to the reason that the packing density percentage of the metal powders in this Example 5 was lower than that of the metal powders in Example 2.

COMPARATIVE EXAMPLE 5

An experiment was carried out in the same manner as described in Example 5, except that the round rod consisting of agglomerated electrolytic copper powders and used in Example 5 was replaced by a copper round rod having the same dimension so that of the rod used in Example 5.

When the resulting shaped article was cut off, and the section was examined, a void having an irregular shape was observed between the copper round rod and the amorphous alloy layer, and a large number of cracks extended towards the interior of the amorphous alloy layer from the void, and there was no portion which was able to be used as an amorphous alloy shaped article.

The round copper rod used in this experiment had the theoretical density of copper, and the shock impedance of the round copper rod was 3,864,000 g/sec.cm$^2$, which was 3.1 times of 1,260,000 g/sec.cm$^2$ of the shock impedance of the amorphous alloy powders, that is, the shock impedance of the round copper rod was 210% higher than that of the amorphous alloy powders.

What is claimed is:

1. A method for producing an amorphous alloy shaped article, comprising arranging an amorphous alloy or atomized alloy raw material powder layer adjacent to a metal powder layer in one pressing vessel to form a laminated powder layer assembly, said metal powder layer having a shock impedance nearly equal to or a little different from that of the raw material powder layer, and then applying a shock pressure to the raw material powder layer.

2. A method according to claim 1, wherein the shock impedance of the metal powder layer is not more than 70% higher or lower than that of the raw material powder layer.

3. A method according to claim 1, wherein the amorphous alloy or atomized alloy raw material powder is a mixed powder comprising large particles and small particles.

4. A method according to claim 3, wherein the amorphous alloy or atomized alloy raw material powder consists of a homogeneous mixture of large size particles and small size particles.

5. A method according to claim 4, wherein the amorphous alloy or atomized alloy raw material powder has a ratio of an average diameter of large size particles to an average diameter of small size particles within the range of from 2:1 to 5:1.

6. A method according to claim 5, wherein each particle of the amorphous alloy or atomized alloy raw material powder has a ratio of a maximum diameter to a minimum diameter, and an average value of the ratios of the maximum diameter to the minimum in all the particles is not higher than 2:1.

7. A method according to claim 6, wherein the particles of the amorphous alloy or atomized alloy raw material powder have substantially a globular shape.

8. A method according to claim 4, wherein the amorphous alloy or atomized alloy raw material powder mixture has a mixing ratio of large size particles to small size particles within the range of from 1:1 to 10:1 by weight.

9. A method according to claim 1, wherein the shock pressure is generated by an explosion.

10. A method according to claim 9, wherein the shock pressure is at least 5 GPa.

11. A method according to claim 10, wherein the shock pressure is at least 8 GPa.

12. A method for producing amorphous alloy shaped articles comprising the steps of arranging laminately an amorphous alloy or atomized alloy raw material powder layer adjacent to a metal powder layer having a shock impedance nearly equal to or a little different from that of the raw material powder layer, and applying a shock pressure to the raw material powder layer; wherein the raw material powder layer is arranged in a hollow cylindrical pressing vessel so as to form a laminated powder layer assembly together with the metal powder layer such that the raw material powder layer surrounds a core-shaped metal powder layer occupying the center portion of the vessel and contacts to the inner wall of the vessel, and the raw material powder layer is coaxially pressed into a compact body in the vessel together with the metal powder layer.

13. A method for producing amorphous alloy shaped articles comprising the steps of arranging laminately an amorphous alloy or atomized alloy raw material powder layer adjacent to a metal powder layer having a shock impedance nearly equal to or a little different from that of the raw material powder layer, and applying a shock pressure to the raw material powder layer; wherein the raw material powder layers are arranged in a box-shaped pressing vessel so as to form a sandwich-like laminated powder layer assembly, wherein the metal powder layer is held between the raw material powder layers, and the raw material powder layers are pressed into a compact body together with the metal powder layer by said shock pressure.

* * * * *

UNITED STATES PATENT AND TRADEMARK OFFICE

CERTIFICATE OF CORRECTION

PATENT NO. : 4,713,871

DATED : December 22, 1987

INVENTOR(S) : Masatada ARAKI; Yutaka KUROYAMA; Yukihisa TAKEUCHI; Makoto TAKAGI; Toru IMURA It is certified that error appears in the above-identified patent and that said Letters Patent is hereby corrected as shown below:

ON TITLE PAGE:

Please correct the name of the Assignee as follows:

Change "Nippon Denso Co., Ltd." to --Nippondenso Co., Ltd.--.

Signed and Sealed this

Eighth Day of October, 1991

*Attest:*

HARRY F. MANBECK, JR.

*Attesting Officer*

*Commissioner of Patents and Trademarks*